US005639071A

United States Patent [19]

Kitchen

[11] Patent Number: 5,639,071

[45] Date of Patent: Jun. 17, 1997

[54] SUPPORT RAIL WITH IMPROVED SPRING MOUNTING CAPABILITIES

[75] Inventor: John P. Kitchen, Georgetown, Ky.

[73] Assignee: L&P Property Management Company, Chicago, Ill.

[21] Appl. No.: 626,044

[22] Filed: Apr. 1, 1996

[51] Int. Cl.[6] ..... A47C 23/00; A47C 23/04

[52] U.S. Cl. ..... 267/100; 5/264.1; 5/255

[58] Field of Search ..... 5/264.1, 263, 265, 5/266, 247, 255, 239, 245; 267/100, 103, 107, 106

[56] References Cited

U.S. PATENT DOCUMENTS

| | | | |
|---|---|---|---|
| 711,161 | 10/1902 | Hoefer | 5/264.1 |
| 1,096,801 | 5/1914 | D'Arcy | 5/264.1 |
| 1,127,198 | 2/1915 | D'Arcy | 5/264.1 |
| 4,121,309 | 10/1978 | Pringle | 5/264.1 |
| 4,779,292 | 10/1988 | Dabney | 5/264.1 |
| 4,861,002 | 8/1989 | Dabney | 5/264.1 |
| 5,176,367 | 1/1993 | Rodgers et al. | 5/247 |
| 5,246,210 | 9/1993 | Dabney et al. | 5/255 |

FOREIGN PATENT DOCUMENTS

| | | | |
|---|---|---|---|
| 129812 | 1/1901 | Germany | 5/264.1 |

*Primary Examiner*—Alexander Grosz
*Attorney, Agent, or Firm*—Harness, Dickey & Pierce, P.L.C.

[57] ABSTRACT

A support rail for springs as might be used in a spring assembly such as a bedding or seat foundation. The support rails are metal and form part of a frame to which the springs are mounted. The support rails have a generally inverted U-shape and include a pair of spaced upright webs with a load carrying plate extending between and located below the upper ends. The plate is further defined by a base and side sections which curve outwardly and upwardly from the base before connecting to the upper ends of the webs. The curves of the side sections define inwardly facing receptacles located immediately below a necked area of reduced width. The support rails are utilized with springs that include at least one mounting portion shaped to snap mount into the receptacles upon downward insertion into the load carrying plate. Features are also provided to limit longitudinal movement of the springs relative to the support rails once mounted.

18 Claims, 4 Drawing Sheets

SUPPORT RAIL WITH IMPROVED SPRING MOUNTING CAPABILITIES

BACKGROUND OF THE INVENTION

This invention generally relates to support rails used in spring assemblies such as bedding foundations, seat assemblies and the like and, more particularly, to metal support rails having improved spring mounting capabilities.

Generally, a box spring assembly includes a rectangularly shaped and horizontally positioned frame above which is supported a mattress support deck. A plurality of spring modules are interposed between the frame and deck to support the deck. At their upper ends, the springs include deck attaching portions which interact with the deck so as to attach the springs to it. At their lower ends, prior springs have typically included a pair of mounting feet for attachment to the frame. A grid-like network of deck wires forms the deck and the grid wires which extend both longitudinally and transversely between a border wire. The support springs yieldably support the deck a predetermined distance above the frame.

Most often, the frame itself is formed with a wood perimeter that defines the sides and ends of the frame. Cross rails transversely span the width of the frame and are formed out of either metal or wood. Depending on the type of cross rail, the mounting feet of the springs are secured to the cross rails by various methods. If the cross rail is wooden, the mounting feet of the springs are generally stapled in place on the cross rail. If the cross rail is constructed from metal, each mounting foot is typically provided with a U-shaped horizontal wire portion that is transversely inserted into a slot defined in the cross rail.

While most formed wire springs have had two opposed yieldable portions, each with a mounting foot at its lower end, newer varieties of the formed wire springs have been constructed with only a single mounting foot integrally formed with both of the yieldable portions. One such spring is disclosed in U.S. Pat. No. 5,176,367. This patent is commonly assigned to the assignee of the present application. These springs, however, do not readily lend themselves to mounting with metal cross rails. As is evident from the '367 patent, that design is easily and efficiently mounted to a frame having wooden cross rails through the use of staples. This mounting method has proven satisfactory but, obviously, it is not feasible with metal cross rails which are often desired because of their increased rigidity.

One current trend in the industry is to minimize the amount of assembly required by the end manufacturer while still maximizing space during the shipping of components to that facility. A further trend is to decrease the number of fasteners and variety of springs utilized in the assembly.

In the '367 patent mentioned above, the springs are capable of being mounted to the support deck without fasteners and prior to shipping to the final assembler. Shipping is maximized because the specific construction of the springs was designed so that the deck/spring combination could be stacked and nested within similar deck/spring combinations. One principal element which permits the stacking and nesting of the deck/spring combinations is the V-shape of the springs themselves. This is not readily achievable when the springs have mounting feet on the lower ends of each yieldable section. The present invention, however, can be utilized with either variety of spring.

SUMMARY OF THE INVENTION

The springs utilized in the present invention are generally V-shaped and include a pair of downwardly extending yieldable sections. The upper ends of the yieldable sections each include a mounting bar which mounts the springs to the deck. The lower ends of the yieldable portions are unitarily formed with a mounting portion. The mounting portion is provided in a configuration which interacts with the frame so as to allow the spring to be snap mounted into the cross rails of the frame.

The frame, as suggested above, is rectangular in shape and includes a wooden perimeter which defines its sides and ends. Extending transversely between the sides of the frame are metal support or cross rails. The location of the springs coincides with that of the cross rails and the rails support and locate the springs by engaging the mounting portions.

More specifically, each cross rail exhibits a generally inverted U-shape which includes a pair of spaced apart upright sides or webs. A load carrying plate extends between the webs and is located at a position below the upper ends of the webs. Extending outward from the lower ends of the webs are mounting flanges that facilitate the mounting of the cross rails to the sides of the frame. The load carrying plate includes base and side support sections which extend upward and connect with the upper end of the webs. Proceeding from the base, the side support sections curve outwardly then inwardly to form opposed receptacles or grooves. When formed in this manner, the side sections exhibit an inwardly curved or directed portion which is herein referred to as a side bead.

The configuration of cross rails and the shape of the springs are such that the mounting portions of the springs are biased and retained in the receptacles formed in the side support sections of the cross rails. In order to mount the support springs to the cross rails, one only needs to locate the support spring at the appropriate position along the length of the cross rail and push firmly downward until the spring "snaps" into place.

The cross rail is formed with a retaining feature. This retaining feature ensures that once the spring is mounted on the cross rail it remains mounted at the desired location for proper functioning of the assembly.

The combination of the springs "snap" mounting into the cross rails of the frame and the interlocking of the springs with the deck allows the springs to be completely mounted in the assembly without the use of any fasteners. This minimizes the number of components associated with the box spring assembly thereby reducing cost and complexity. In addition, a nestable and stackable deck/spring combination can now be utilized with frames having cross rails according to the present invention further saving assembly and shipping costs.

It is an object of the present invention to provide a box spring assembly having metal cross rails.

It is also an object of this invention to provide a mechanism by which springs can be mounted to metal cross rails.

It is a further object of the present invention to provide a spring assembly in which the mounting feet of springs are mounted to cross rails of the frame without the use of clips or other fasteners.

An object of this invention is also to provide a system where the spring is easily snap mounted into the cross rail.

An additional object of this invention is to provide a mounting system which allows the springs to be located at various positions along the length of the cross rail.

Yet another object of the present invention is to provide a cross rail mounting system where the mounting feet of the springs are specifically located into a predetermined position along the length of the cross rail and positively retained in that position once mounted.

In achieving these and other objects, the present invention provides a support rail for springs as might be used in a box spring assembly. While other uses can be envisioned, the present invention is being described herein only in connection with box spring assemblies. Notwithstanding this, the invention should not be interpreted as being limited only to those assemblies.

Additional benefits and advantages of the present invention will become apparent to those skilled in the art to which the present invention relates from the subsequent description of the preferred embodiment and the appended claims, taken in conjunction with the accompanying drawings.

DETAILED DESCRIPTION OF THE PREFERRED EMBODIMENT

Figure 1:
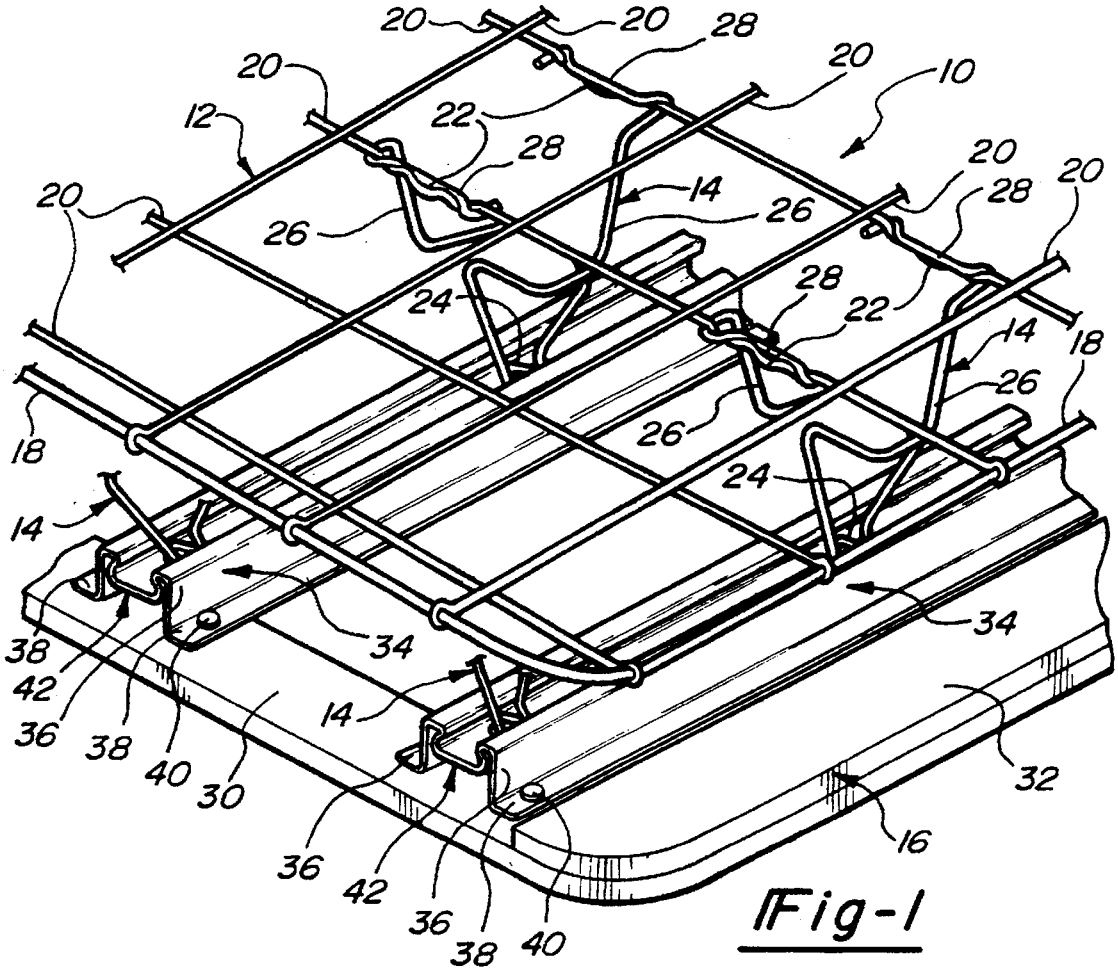
FIG. 1 is a perspective view of a portion of a box spring assembly incorporating the features of the present invention.

Referring now to the drawings, the present invention is shown incorporated into a box spring assembly which is partially illustrated in FIG. 1 and designated at 10. The box spring assembly 10 is generally made up of three principal components: a support deck 12, spring modules 14 and a frame 16.

The support deck 12 (hereinafter deck 12) is yieldably supported by the spring modules 14 (hereinafter springs 14) a predetermined distance above the frame 16. The perimeter of the frame is defined by a border wire 18 which extends substantially continuously around the support deck 12 and corresponds with the perimeter of the frame 16. The border wire 18 therefore defines a pair of opposing sides and ends. Attached to the border wire 18 and extending between the opposing sides and ends are deck wires 20, some of which extend lengthwise and others of which extend cross wise relative to the box spring assembly 10. Together, the deck wires 20 form a criss-crossed, grid-like network that will distribute the loads applied to the box spring assembly 10. For reasons more fully described below, if desired, at least some of the deck wires 20 are formed with periodic, vertical offsets 22.

An array of springs 14 yieldably support the deck wires 20 a predetermined distance above the frame 16. While it will be appreciated that numerous different configurations for the springs 14 themselves can be employed with the present invention, particular utility will be had with the springs 14 disclosed in U.S. Pat. Nos. 5,246,210 and 5,176,367, both of which are referenced herein and which have been commonly assigned to the assignee of the present invention. Those springs are designed so they can be stacked with one another and include only one mounting foot 24 for attachment to the frame 16. It is also anticipated that non-stackable, formed wire springs having more than one mounting foot will find equally broad utility with the present invention. While the present invention is being illustrated and discussed with specific reference to stackable springs 14, it is in no way intended for the present invention to be interpreted as being so limited. The full range of equivalents therefore includes all configurations of formed wire springs having one or more mounting feet which are intended to engage a cross rail.

The mounting foot 24 of springs 14 is unitarily formed with and interconnects the lower ends of a pair of upwardly extending yieldable sections 26. While the configuration of the yieldable sections 26 need not be specified with respect to the present invention, as seen in FIG. 1 the yieldable sections 26 of the illustrated springs 14 include a series of substantially upright portions and torsion bars. This type of spring 14 is known in the industry as a formed wire, limited deflection spring. The upper ends of the yieldable sections 26 are each unitarily formed with an attaching bar 28. The attaching bars 28 are configured to interact with the vertical offsets 22 of the deck wires 20 so as to interlock and mount the springs 14 to the deck 12. Preferably, the engagement of the attaching bars 28 with the deck wires 20 will be such that clips or other types of fasteners will not be required thereby allowing for quick installation and mounting of the springs 14 with the deck 12.

Another feature of the deck/spring combination is that the springs 14 and deck 12 can be assembled together at the component manufacturer, then stacked with additional deck/spring combinations so that, when shipped to the end manufacturer, shipping space is maximized. In providing such a deck/spring combination, it is beneficial if the springs 14 are capable of nesting within one another. One method of achieving this is to have the springs 14 exhibit a cone or V-shape which diverges from a single mounting foot 24 upward toward the attaching bars 28. This allows for the nesting of one spring 14 within another spring 14 after they have been mounted to the deck 12.

The frame 16 itself includes a perimeter which is defined by wooden side rails 30 and end rails 32. Extending between the side rails 30 are metal cross rails 34. The springs 14 are secured to the cross rails 34.

Three embodiments of the cross rails 34 are discussed below as are two embodiments of the spring mounting foot 24. After reviewing the following discussion, it will be appreciated that numerous additional variations on the actual configuration of the cross rails 34 and mounting feet 24 are possible. All such variations are fully intended to be within the scope of this invention and disclosure.

Figure 2:
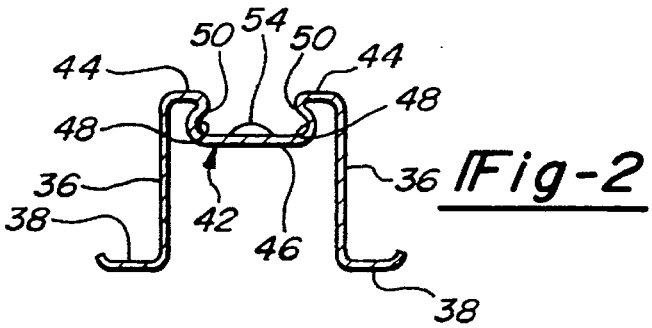
FIG. 2 is a sectional view of a cross rail according to one embodiment of the present invention.

The first embodiment of the present invention is illustrated in FIG. 2. The cross rail 34 can generally be seen as a hat section having an inverted U-shape when viewed in vertical cross section. A pair of spaced apart, generally upright side webs 36 define the exterior sides of the cross rail 34 and the lower ends of the webs 36 are provided with flanges 38. The flanges 38 extend angularly outward from the webs 36 and facilitate mounting of the cross rails 34 onto the side rails 30 of the frame 16. Any conventional method can be used to secure the cross rails 34 to the side rails 30 including the use of nails, screws or other fasteners 40 inserted through slots or holes. The upper ends of the webs 36 are interconnected with each other by a load carrying plate 42.

The plate 42 itself is comprised of a pair of side support sections 44 which extend generally downward from the upper ends of the webs 36 to a horizontally extending supportive base 46 which interconnects their lower ends. The side sections 44 curve outwardly and upwardly from the base 46 in a general S-shaped configuration which defines oppositely located grooves 48 that operate as receptacles 48 for the mounting foot 24 of the spring 14. These grooves 48 are bounded by the base 46 on their lower periphery and a longitudinally extending side bead 50 on their upper periphery. The shape of the grooves 48 and the width of base 46 itself, are such that the mounting foot 24 of the spring 14 can be received and retained therein. Accordingly, the opposed beads 50 define a width which is less than that defined by the opposed grooves 48. The mounting foot 24 itself exhibits an overall width which generally corresponds to the width defined by the grooves 48. Additionally, the curvature or profile of the grooves 48 corresponds with the exterior surface curvature or profile of the mounting foot 24.

To mount the spring 14 to the cross rail 34, the mounting foot 24 of the spring 14 is located at the desired position along the length of the cross rail 34, and then pushed downward. As the mounting foot 24 is forced downward, the mounting foot 24 is forced through the narrow necked area defined by the opposed beads 50 and, upon passing through this necked area, the mounting foot 24 is inherently biased outwardly causing it to "snap" into engagement with the opposingly positioned grooves 48. Obviously, the precise configuration of the mounting foot 24 can vary so long as it inherently is biased outward and has an overall width which is greater than the width defined by the beads 50. More preferably, the width of the mounting foot 24 is about the same as the width defined by the opposed grooves 48. Still more preferably, the mounting foot 24 width is at least slightly greater than the width defined by the opposed grooves 48. In the first embodiment, the mounting foot 24 is provided with a Z-shaped or zig-zag configuration. In this configuration, the mounting foot 24 generally includes two outside bends 52, one of which is engaged in each of the opposed grooves 48.

Figure 3:
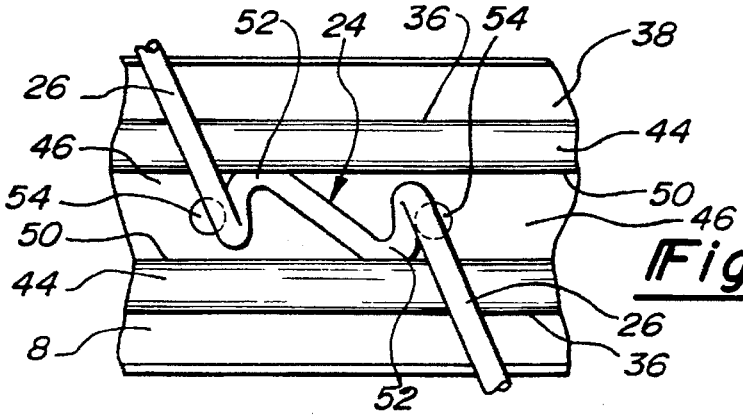
FIG. 3 is a partial plan view of one embodiment of a spring mounting foot engaged with the cross rail illustrated in FIG. 2.

The inherent biasing of the mounting foot 24 operates to essentially lock the mounting foot 24 in engagement with the load carrying plate 42. While this does prevent some longitudinal movement, to further prevent longitudinal movement of the spring 14 along the cross rail 34 and to more precisely locate the spring 14 at a predetermined location along the length of the cross rail 34 raised bosses or buttons 54 are formed in the base 46 of the load carrying plate 42. The buttons 54 are provided in pairs, as seen in FIG. 3, and preferably, each pair of buttons 54 is spaced apart a minimum distance which corresponds to the overall length of the mounting foot 24 enabling the mounting foot 24 to be received therebetween. In this manner, the buttons 54 will engage the longitudinal ends of the mounting foot 24 preventing rotational disengagement and providing lateral stability.

Figure 4:
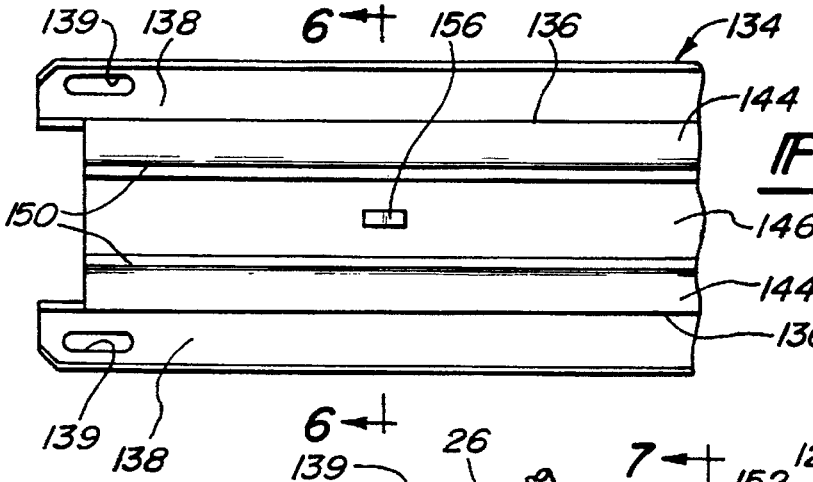
FIG. 4 is a plan view of a portion of a cross rail according to a second embodiment of the present invention.
Figure 7:
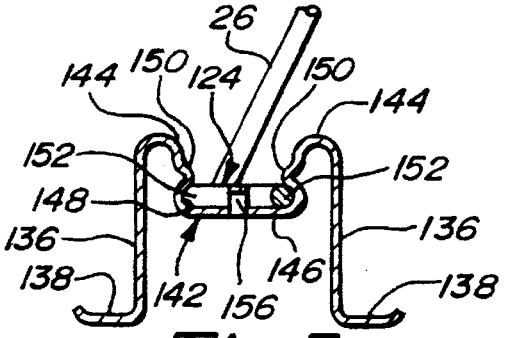
FIG. 7 is a sectional view taken substantially along line 7—7 in FIG. 5.
Figure 8:
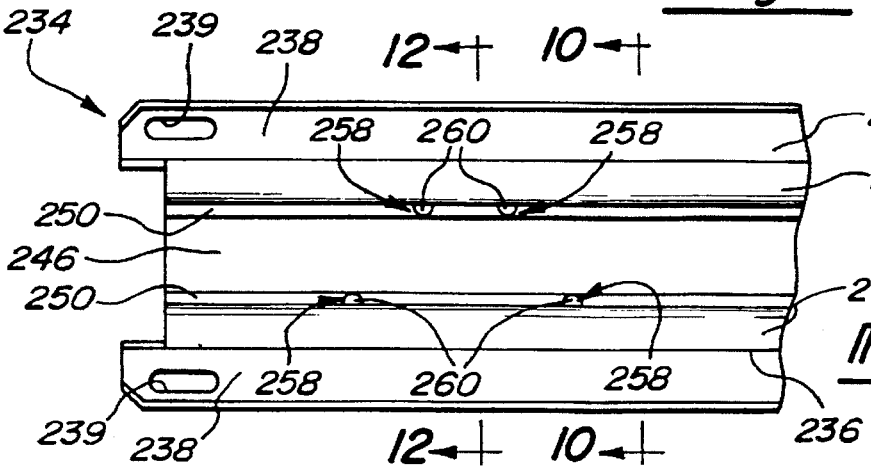
FIG. 8 is a plan view of a portion of a cross rail according to the principles of the present invention and illustrating a third embodiment therein.

In the second embodiment of the present invention, as seen in FIGS. 4 and 7, the mounting rail 134 continues to exhibit a generally inverted U-shape and, as with the prior embodiment, a pair of upright webs 136 that terminate at their lower ends in outwardly angled mounting flanges 138. The mounting flanges 138 may be provided with slots 139 to aid in their mounting to the side rails 30 of the frame 16. The upper ends of the webs 136 are unitarily connected by a load carrying plate 142 made up of side sections 144 and a base 146. The side sections 144 support the base 146 at a position beneath the upper ends of the webs 136.

Proceeding upward from the base 146, the side sections 144 curve outwardly then inwardly to respectively define a pair of opposed grooves or receptacles 148 and an opposed pair of longitudinally extending beads 150. Unlike the first embodiment, in this second embodiment, the beads 150 are not immediately adjacent to the upper ends of the webs 136, but rather are located a distance, approximately half way, between the upper ends of the webs 136 and the base 146. The beads 150 define a narrow necked area relative to the width defined by the grooves 148. This again causes the mounting foot 124 of the spring 14 to "snap" into engagement with the cross rail 134 as it is pushed downwardly into the grooves 148 of the load carrying plate 142. The mounting foot 124 continues to exhibit an overall width which is greater than the width defined by the opposed beads 150. The overall width of the mounting foot 124 substantially corresponds to the width of the grooves 148, preferably being slightly greater than that width.

Figure 5:
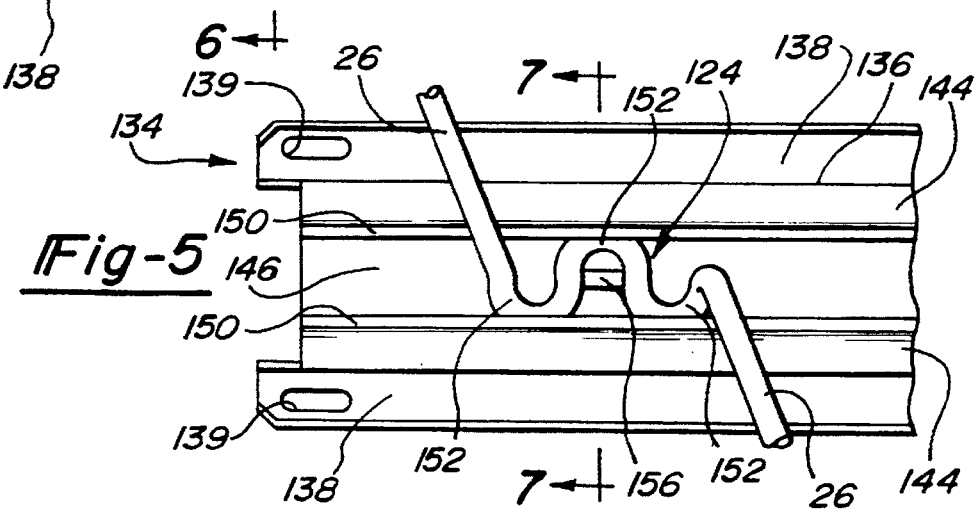
FIG. 5 is a plan view of the cross rail seen in FIG. 4 additionally having the mounting portion of a second embodiment of a spring engaged therewith.
Figure 6:
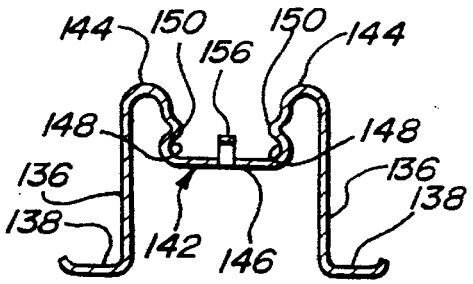
FIG. 6 is a sectional view taken substantially along line 6—6 in FIG. 4.

The mounting foot 124 seen in FIG. 5 also exhibits a configuration which differs from the mounting foot 24 of the first embodiment. In this second embodiment, the mounting foot 124 exhibits three alternating outward bends 152. Two of the bends 152 engage one of the opposed grooves 148 and the remaining or center bend 152 engages the opposite groove 148.

In order to retain the spring 14 in the appropriate position along the length of the cross rail 134, the second embodiment utilizes a stop tab 156 which is lanced and bent up out of the base 146 between the side sections 144. The tab is formed with a length that allows it to be positioned within the interior curve defined by the center bend 152. Positioned within this bend 152, the tab 156 interferingly engages the mounting foot 124 during longitudinal movement and prevents movement of any significance.

The third embodiment of the present invention is generally illustrated in FIGS. 8–14. Similar to the first two embodiments, a cross rail 234 is formed in an inverted U-shape. The sides of the cross rail 234 are defined by generally upright webs 236 and mounting flanges 238 extend angularly outward from the lower ends of the webs 236. Slots 239 provide an area through which a fastener 40 can be inserted to fasten the cross rail 234 to the side of the frame 16.

The upper ends of the webs 236 are unitarily formed with each other and connected by a load carrying plate 242. Side support sections 244 of the plate 242 extend from the upper end of the webs 236 and terminate in a substantially horizontal base 246. Proceeding upward from the base 246, the side support sections 244 are curved outward and then curved inward to first define a pair of grooves 248 and then define a pair of beads 250, both of which respectively face one another. In a manner similar to the previous embodiments, the beads 250 define a necked area whose width is narrower than the width defined by the grooves 248. The differing widths permit the mounting foot 124 of a spring 14 to "snap" into engagement with the load carrying plate 242 as previously described.

Figure 14:
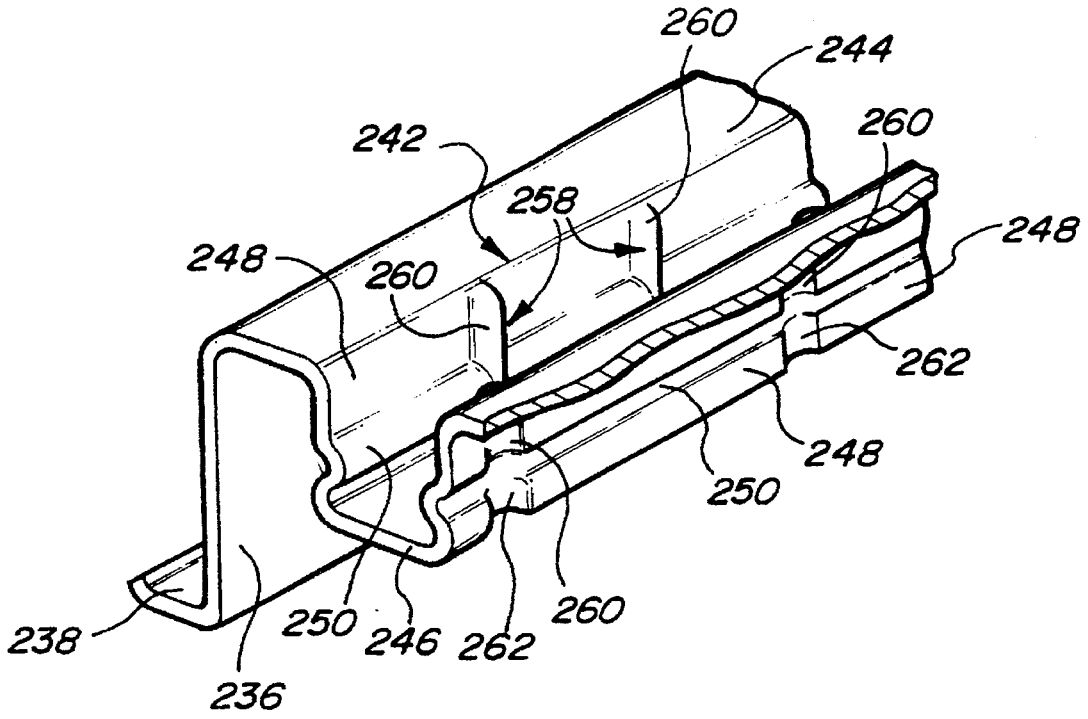
FIG. 14 is a perspective view of a portion of the cross rail seen in FIGS. 8—13 illustrating the bead configuration on the side support sections.

The third embodiment differs from the previous embodiments in that the side sections 244 are additionally provided with vertical beads 258 that intersect the longitudinal beads 250. In the preferred version of this embodiment, four vertical beads 258 are grouped together to interact with one mounting foot 124. Per group, two vertical beads 258 are positioned on each side section 244 and each individual bead 258 includes an upper bead 260 and a lower bead 262. The horizontal beads 250 and vertical beads 258 thus cooperate to define a generally cross-like structure in the side sections 244 as seen in FIG. 14.

The upper beads 260 are intended to allow the assembler to easily locate the position of the spring 14 and to guide the spring as it is downwardly inserted into the load carrying plate 242. The lower beads 262 operate to prevent longitudinal movement of the spring 14 once mounted. Obviously, the invention could be practiced with less than four vertical beads 258 per group. Additionally, all the upper beads 260 could be omitted but this would eliminate the guiding function and ability mentioned above.

Figure 9:
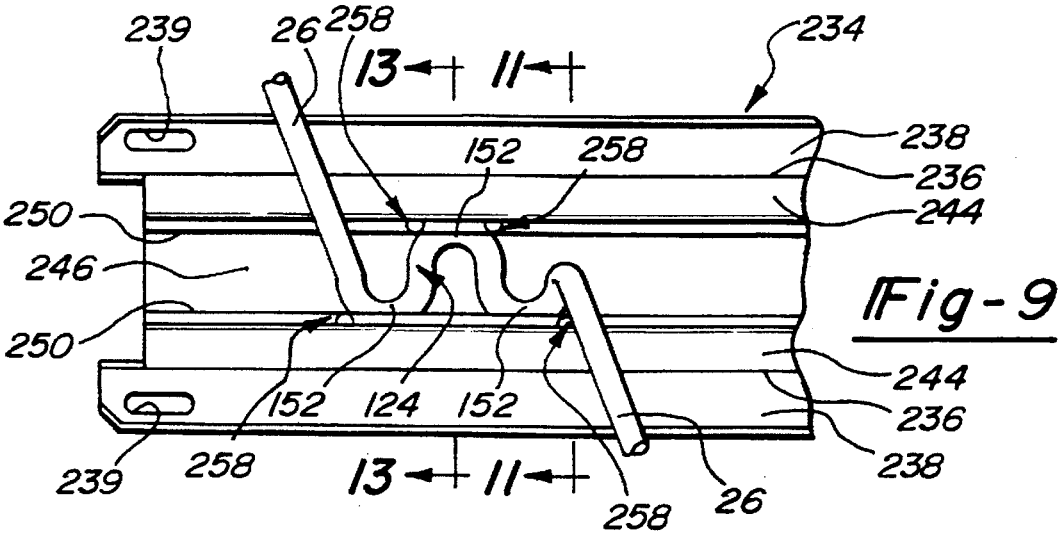
FIG. 9 is a plan view of the cross rail illustrated in FIG. 8 having the mounting portion of a spring engaged with it.
Figure 10:
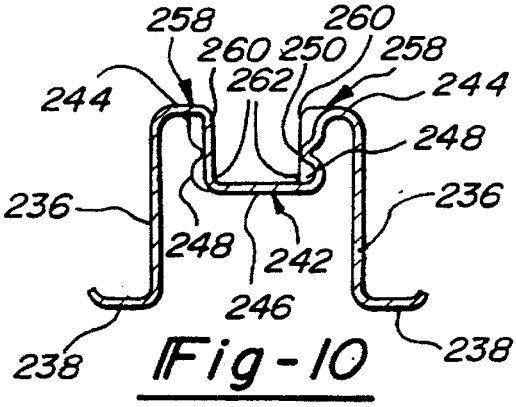
FIG. 10 is a sectional view taken substantially along line 10—10 in FIG. 83.
Figure 11:
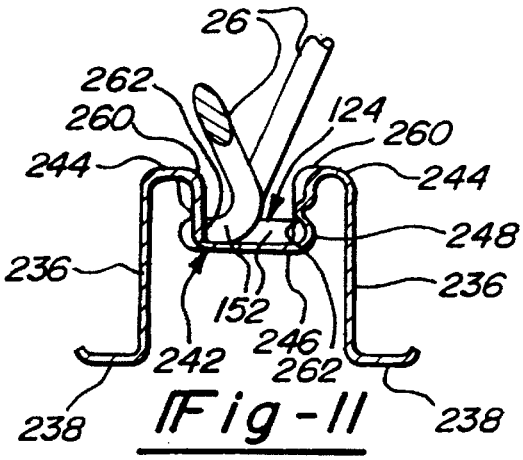
FIG. 11 is a sectional view taken substantially along line 11—11 in FIG. 9.
Figure 12:
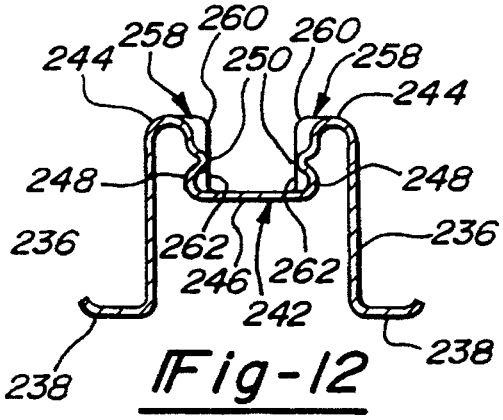
FIG. 12 is a sectional view taken substantially along line 12—12 in FIG. 8.
Figure 13:
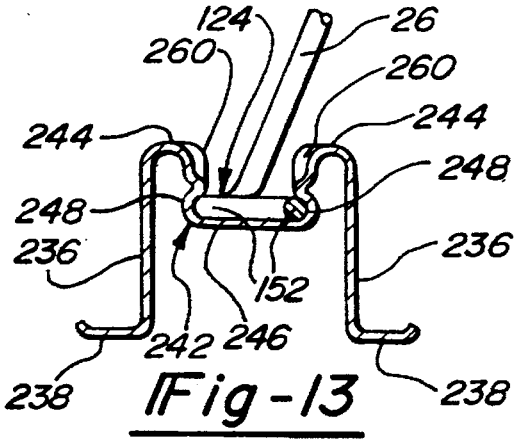
FIG. 13 is a sectional view taken substantially along line 13—13 in FIG. 9.

As seen in FIG. 9, the vertical beads 258 are located so that each pair of beads 258 on one side section 244 are positioned a distance apart which corresponds with the overall length of the mounting foot 124 adjacent to it. The beads 258 on one side contact the endmost portions of the outer two bends 152 of the mounting foot 124 while the two vertical beads 258 on the opposing side section 244 are spaced apart to accommodate the center bend 152 of the mounting foot 124 between them.

During mounting of the spring 14 to the cross rail 234, the mounting foot 124 is positioned on the cross rail 234 so that the two outer bends 152 and the center bend 152 of the mounting foot 124 are each positioned between the appropriate pair of upper beads 260. This properly locates the spring 14 and guides the mounting foot 124 during downward insertion into the load carrying plate 242. After passing between the necked area and the longitudinal beads 250, the mounting foot 124 is inherently biased outward into its normal shape and the lower beads 262 cooperate with the bends 152 to prevent inadvertent longitudinal movement of the spring 14.

In all of the above described embodiments, it is possible for the mounting foot 124 of a spring 14 to be easily mounted with a metal cross rail 34 without requiring the use of fasteners. The above system also provides a metal cross rail 34 which has the ability to accommodate and engage springs having a single mounting foot design. As such, the present invention significantly increases production while decreasing the cost associated with mounting the support deck 12 and springs 14 to the cross rails 34 of the frame 16.

While the above description constitutes the preferred embodiment of the present invention, it will be appreciated that the invention is susceptible to modification, variation and change without departing from the proper scope and fair meaning of the accompanying claims.

I claim:

1. In a spring assembly which includes a frame having cross rails and a plurality of load supporting spring members mounted on said cross rails wherein each of said cross rails is of a generally inverted U-shape with a pair of spaced upright webs having upper ends, lower ends and a load carrying plate extending between and located below said upper ends, the improvement comprising generally arcuate side support sections upwardly extending from said load carrying plates, said side support sections curving outwardly and upwardly to form receptacles of predetermined shapes in said side sections, and spring modules adapted to be supported on said load carrying plate, said modules having at least one section of a shape which is complementary to said receptacle shapes and which enables said section to snap into engagement with said receptacles so that said spring modules are located at desired positions on said cross rails.

2. The improvement of claim 1 wherein said receptacles generally face toward and oppose one another.

3. The improvement of claim 1 wherein said receptacles extend the length of said cross rails.

4. The improvement of claim 1 wherein said side sections include inwardly curved portions above said receptacles which define a reduced width portion in said support plate.

5. The improvement of claim 4 wherein said inwardly curved portions define beads.

6. The improvement of claim 5 wherein said beads extend the length of said side sections.

7. The improvement of claim 5 wherein said beads are located below said upper ends of said webs.

8. The improvement of claim 1 wherein further comprising stop means for inhibiting longitudinal movement of a spring relative to said cross rail.

9. A spring assembly comprising a frame having cross rails and a plurality of load supporting spring members mounted on said cross rails, at least some of said rails having generally inverted U-shape in cross section with a pair of spaced upright webs having upper ends and lower ends, a load carrying plate extending between said upper ends, mounting means located at the lower ends of said webs for facilitating mounting of said rails on said frame, said load carrying plates including a base located below said upper ends of said webs and having generally upwardly extending side support sections which are curved outwardly and upwardly from said base to form facing receptacles in said side sections, said side sections including portions forming a necked area having a width being less than a width defined between said receptacles, spring modules adapted to be supported on said load carrying plates and at least some of said spring modules having mounting sections shaped to snap mount into said receptacles in said side sections, said mounting sections having a width being greater than the width defined by said necked area, and spring module retainer means formed in said plates at predetermined locations therealong to maintain said spring modules at said predetermined locations on said cross rails and inhibit longitudinal movement thereof.

10. A spring assembly as set forth in claim 9 wherein said retainer means includes raised projections in said load carrying plate.

11. A spring assembly as set forth in claim 9 wherein said retainer means includes raised projections formed in said base of said load carrying plate.

12. A spring assembly as set forth in claim 9 wherein said retainer means includes projections formed in said sections of said load carrying plate.

13. A spring assembly as set forth in claim 9 wherein said retainer means includes at least one generally upwardly oriented rib formed in said side section of said load carrying plate.

14. A spring assembly as set forth in claim 13 wherein said upwardly oriented rib includes an upper rib and a lower rib, said upper rib being located above said necked area and said lower rib being located below said necked area, said upper rib guiding said mounting section of said spring module into proper location on said cross rail and said lower rib inhibiting longitudinal movement of said spring module relative to said cross rail.

15. A spring assembly as set forth in claim 9 wherein said necked area is defined by inwardly curved portions in said side sections located adjacent to said outwardly curved sections.

16. A spring assembly as set forth in claim 9 wherein said necked area is defined by generally opposed beads located on said side sections and extending longitudinally thereal-ong.

17. A spring assembly as set forth in claim 9 wherein said spring module includes a pair of yieldable sections being unitarily formed with one another and including said mounting section.

18. A spring assembly as set forth in claim 17 wherein said mounting section includes at least two bends therein, said bends engaging said receptacles when said spring module is mounted in said cross rail.

* * * * *